US005363971A

United States Patent [19]

Weeks et al.

[11] Patent Number: 5,363,971

[45] Date of Patent: Nov. 15, 1994

[54] AUTOMATIC CARRIER SEQUENCE BAR CODE SORTER

[75] Inventors: Horace W. Weeks, Towson; James J. Strohmeyer, Hampstead; Jeffrey R. Nice, Sykesville, all of Md.

[73] Assignee: United States Postal Service, Washington, D.C.

[21] Appl. No.: 961,980

[22] Filed: Oct. 16, 1992

[51] Int. Cl.[5] ..... B07C 5/00; B65H 5/22

[52] U.S. Cl. ..... 209/584; 209/900; 271/3.1; 271/165; 414/788.8; 414/794.8

[58] Field of Search ..... 209/546, 547, 583, 584, 209/900; 271/3.1, 157, 163, 160, 165, 288; 414/788.8, 794.4, 794.8, 797.6, 926, 924; 221/35

[56] References Cited

U.S. PATENT DOCUMENTS

| | | | |
|---|---|---|---|
| 3,106,314 | 10/1963 | Spears | 221/35 |
| 4,379,549 | 4/1983 | Mizuma | 271/163 X |
| 5,097,959 | 3/1992 | Tilles et al. | 209/584 |
| 5,097,960 | 3/1992 | Tilles et al. | 209/900 X |
| 5,119,954 | 6/1992 | Svyatsky et al. | 209/584 |
| 5,143,225 | 9/1992 | Rabindran et al. | 271/3.1 X |
| 5,146,286 | 9/1992 | Rees et al. | 271/163 X |

FOREIGN PATENT DOCUMENTS

| | | | |
|---|---|---|---|
| 0060596A1 | 9/1982 | European Pat. Off. . | |
| 2643836 | 9/1990 | France | 209/900 |

*Primary Examiner*—D. Glenn Dayoan
*Assistant Examiner*—Tuan N. Nguyen
*Attorney, Agent, or Firm*—Lowe, Price, LeBlanc & Becker

[57] ABSTRACT

A machine for sorting documents and, in particular, for carrier sequence bar code sorting of mail has been described. The device uses three passes and 11 vertically disposed top fed stackers. The stackers also have a delivery system from the bottom thereof so that mail selectively dispensed from the bottom of each individual stacker proceeds through a buffer singulator, leveler, and wide area bar code reader which in turn signals the computer so that as the mail piece is transported through a top transport, it will be gated into the proper stacker in the proper sequence. The machine also may be adapted to an overflow situation wherein mail overflowing one stacker is diverted to an overflow stacker for recycling and the mail to be sorted is assigned in predetermined quantities to different stackers to minimize the possibility of overflow.

24 Claims, 7 Drawing Sheets

AUTOMATIC CARRIER SEQUENCE BAR CODE SORTER

The invention herein described was made in the course of or under a contract or subcontract thereunder with the United States Postal Service.

FIELD OF THE INVENTION

This invention relates to an automatic machine for sorting documents and, in particular, for sorting mail which is capable of sequencing an individual's mail carrier's mail to each individual route stop. The device of this invention then is intended to automatically take a random selection of mail and sort it automatically to the individual mail carrier's route sequence which may be up to 1,000 different stops.

BACKGROUND OF THE INVENTION

Since the advent of mail delivery, one of the duties associated with mail delivery has been the sorting of mail by the individual mail carrier into a sequence corresponding to the stops on his particular mail route. This has often been a very time-consuming procedure which can take up to half a work day. It is desired then to provide a means for sorting the mail faster, thus providing the carrier with more time to deliver mail.

In recent years, attempts to automate the postal service have taken a number of forms. For example, machines such as the multi-line OCR, the 880 bar code sorter (BCS), and the delivery bar code sorter (DBCS) have been provided to sort mail. Typically, these machines now sort mail by zip code or by bar code corresponding to the zip code. Only recently have attempts been made to provide carrier sequence bar code sorting with an intent to facilitate mail handling functions.

Carrier sequence bar code sorters have been described in U.S. Pat. Nos. 5,097,959 and 5,097,960 to Tilles et al. These patents are directed to a multiple-pass, sorting machine. This type of machine sorts mail into stackers which fill in a top down sequence with the mail from a previous pass retained at the bottom of the stacker. In one of such patents, a single recirculating vehicle empties the bottom of each stacker individually and indexes along a track for recycling for a further pass. In the second of said patents, multiples of such vehicles are provided for each stacker. Typically, in such a machine, a wide area bar code reader (WABCR) is used. A singulator is also used upstream of the WABCR to arrange the mail individually, and a leveler which is used to align the mail for reading. Once the mail is read, the bar code information is interpreted by a microprocessor and the mail assigned to a particular stack. Also, in U.S. Pat. No. 5,119,954, a multi-pass sorting machine is provided which uses two passes only. In order to meet the normal carrier requirements, this machine requires a minimum of 32 or up to 50 vertical stackers for the mail being sorted. As will subsequently be described, 32 stackers in a two-pass system should be capable of sequencing mail for 1,000 stops. In both patents, the zip code used is an 11-digit zip code which is capable of identifying the carrier's individual stops.

Sorting mail then would mean separating the mail into a vertical stacker for each stop. This could mean, for a typical route, up to 1,000 stackers. However, to sequence the mail, multiple stops will be retained within a single stacker, with the stops in each stacker retained in sequence. By sequencing, the number of stackers required can be reduced.

The number of stackers required will be related to the number of stops and reduced by the number of passes. Accordingly, the number of stackers raised to the power of the number of passes is equal to the number of stops. In this way, a system having 32 stackers which uses two passes would be capable of handing 1,024 stops.

There is a need then to provide a carrier sequence bar code sorter machine which can be operated by the individual mail carrier and which is capable of sequencing the mail in the carrier's route automatically which, in turn, requires the capability of sequencing the mail for 1,000 stops. There is also a need to provide a machine which is compact and suitable for installation at individual postal delivery units. Accordingly, the machine must provide multiple passes and, preferably, would achieve multiple pass sequencing to completion without the need for intermediate sweeping. Sweeping, or unloading, is the manual removal of the mail from the stackers. Obviously, it is desirable to minimize the physical handling of the mail and limit the same to a single sweep at the end of the sequencing operation.

SUMMARY OF THE INVENTION

It has been discovered that a highly reliable and functional carrier sequence bar code sorter machine can be provided which uses three passes and 11 vertical stackers. The machine of this invention provides, in addition, an overflow stacker and a reject stacker. The machine of this invention also utilizes a singulator which organizes the flow of mail into a single piece at a time, a leveler to align the pieces downstream from the singulator, a pivoting arm buffer system to regulate the flow of mail, and a wide area bar code reader downstream of the leveler for reading each mail piece on each pass. Typically, as will be subsequently explained, a look-up directory has been provided and inputted into a microprocessor whereby the zip code information recorded in the bar code is correlated to the stop number on a particular carrier's route. Accordingly, the machine of this invention will read the bar code, interpret the bar code in terms of the carrier's route, and route the particular piece of mail in sequence to the appropriate stacker.

The device of this invention further includes a novel stacker design whereby a stacker paddle is provided within each vertical stacker. Mail is deposited on top of the paddle during an individual pass until the pass has been completed. Substantially constant pressure is maintained on the mail in the stacker as it is deposited on the paddle and, as the stack increases, the paddle moves downward to maintain that pressure. The paddle is also of a zig-zag design which facilitates removal of the paddle from the stacker at the end of a pass, and which facilitates sweeping. When a pass is complete, the paddle is removed to the top of the stack within the individual stacker. With the paddle retracted, the mail in the stacker rests upon a shingler, which may be a vacuum-type shingler. When the subsequent pass is initiated, the shingler feeds the mail from the bottom of the stack into the feed mechanism in the proper order for the singulator, the leveler, and subsequently, the wide area bar code reader (WABCR) so that after being read by the WABCR, the individual mail piece is then resorted to the appropriate stacker. When three passes have been completed, the stackers are swept in order, providing the mail carrier with his route in sequence.

This invention also includes a method for optimizing and redistributing the sorting process to minimize overflow. Specifically, the stackers are initially loaded with mail to be sorted to predetermined heights, decreasing from beginning to end so that the last stacker emptied has the smallest stack of mail. It has been discovered that this distribution substantially eliminates the likelihood one stacker will overflow.

Accordingly, it is an object of this invention to provide an automatic carrier sequence bar code sorter machine which is capable of sorting the mail into a sequence related to each individual carrier stop.

It is another object of this invention to provide a carrier sequence bar code sorter machine which can be operated by the individual carrier and which involves a multiple pass sorting procedure capable of sequencing the mail for 1,000 stops automatically in a compact machine.

It is a further object of this invention to provide a carrier sequence bar code sorter machine which will sort an individual carrier's route of up to 1,000 stops and provide the mail automatically in a predetermined sequence corresponding to the carrier's route in three passes of a multiple pass sorting system.

It is a further object of this invention to provide a document sorting machine consisting of a plurality of vertical stackers which receive documents through the top onto a paddle which is lowered as the documents are received until the stacker has a predetermined number of mail documents. Whereupon, the paddle is removed and indexed upwardly to the top of the stacker. The documents are individually and automatically removed from the bottom of the stacker by the shingler for re-sorting through another pass.

These and other objects will become readily apparent when referenced to the drawings and following descriptions:

DETAILED DESCRIPTION OF THE INVENTION

Figure 1:
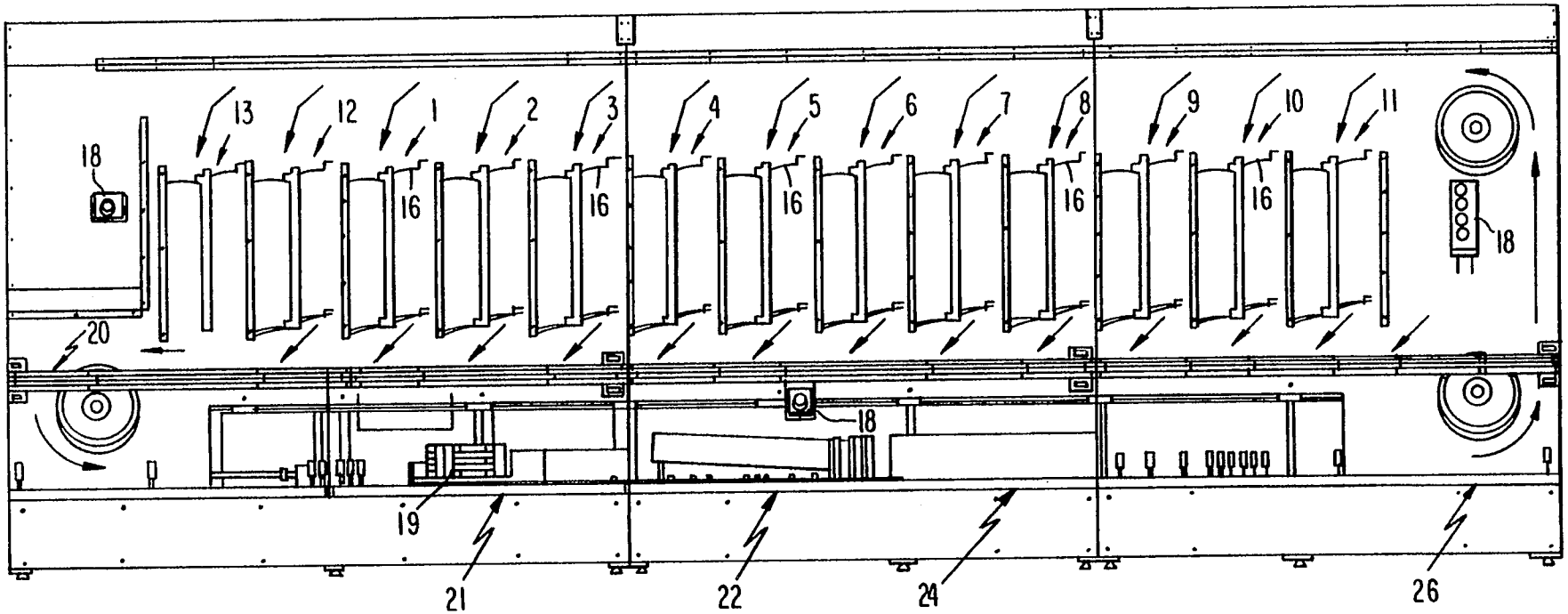
FIG. 1 is a schematic side view of the carrier sequence bar code sorter of this invention.

The sequencing of mail through multiple passes can be a complex concept. However, it can be analogized and explained with reference to a deck of playing cards.

A new deck of playing cards is arranged in order both as to suit and rank starting with ace of clubs, 2 of clubs, 3 of clubs, and so on, continuing to the king of clubs, then diamonds, hearts, and spades. If a machine reads the face of the card and sorts it according to what it reads, the machine could take a randomly shuffled deck of playing cards and place all the cards back into the above sequence.

One way to accomplish this would be to sort each of the cards into one and only one stacker. This would require 52 stackers. The first stacker would then receive the ace of clubs, the second stacker would receive the two of clubs, and so on. By sweeping the stacks from left to right and placing the contents of each stacker on top of the contents of the previous stacker, we would end up with a sequenced deck of cards. This entire process takes one pass through the cards but requires the use of a relatively large number of stackers, 52. This is analogous to the situation of using a single pass sorting machine to sequence mail. However, in the case of sequencing mail, we are sorting to 1,000 stops and would need an equal number of stackers. Obviously, this machine would be of an impractical size.

A better way to sequence the deck of cards would be to use 13 stackers and two passes through the cards. To better understand this process, assume that there is an unordered stream of cards entering the machine. During the first pass, the cards would be sorted by rank, aces, twos, threes, etc., into 13 stackers with no regard to suit. At the end of the pass, the cards in the first stacker would be all aces, the cards in the second stacker would be all twos, and the cards in the last stacker would be all kings. During the second pass, the four cards in the first stacker would be fed out the bottom of the stacker. Immediately following this, the four cards in the second stacker would be fed, and so on. The cards would then be read and resorted into four stackers by suit with no regard to rank. The four aces then would end up on the bottom of each of the fourth stackers since these are the first four cards fed out. One top of these cards would be the twos and so on. At completion, if the cards are swept from left to right, we would end up with a sequences deck of cards.

In the 13 stacker example, during the second pass, only four stackers were utilized. This is because we sorted the cards in a direct method by sorting the deck to the least significant digit (LSD) which was rank. We then sorted to the most significant digit (MSD) which was suit. The 13 LSDs multiplied by the 4 MSDs gave us 52 stops on a two pass machine. If the number of MSDs and the number of LSDs were chosen to be the same, we could achieve the required 52 stops with a minimum of stackers. 52 stops at two passes would be 8 and $8 \times 8 = 64$ possible stops.

The eight stacker sequencing concept requires an indirect sorting method. In this situation, the LSD of each stop is a number from 0 to 7 as is the MSD of each stop. The first stop is numbered 00 and the very last stop is numbered 77. By sorting through two passes, first by the LSD of the stop number and then by the MSD of the stop number, the stops can be arranged in sequential order from 00 to 77. The reader does not sort the cards directly but rather sorts the stop number which corresponds to the number and suit on the card. Prior to sequencing the cards, a look-up table must be generated which relates the different cards to the two-digit stop number in such a manner that the first sequentially ordered table entry (i.e.—ace of clubs) is assigned to the first stop (stop 00) and the last is assigned to the last used stop (stop 63). Entry of that relationship into the central processor then means that when the cards are read for suit rank, the processor will relate that to the stop number and sort accordingly.

Similarly, the wide area bar code reader reads bar coded zip codes on mail pieces. By using multiple passes and indirect assignment of the 11-digit zip code to stackers through their associated stop numbers on the carrier's route, the machine of this invention is capable of sequencing mail up to 1,000 different delivery points automatically.

The general relationship or requirement for the machine of this invention is that it be capable of handling up to 1000 different separations. The general mathematical relationship between the number of stackers, number of passes, and the number of stops is expressed as the stops equal the number of stackers raised to the power of the number of passes. The machine of this invention achieves the desired number of stops in three passes. Minimally, 10 stackers would be required to handle 1000 different separations in three passes. However, the machine of this invention utilized 11 sort stackers providing additional capacity and greater flexibility, as will be subsequently described.

SYSTEM OPERATION

With attention to FIG. 1, the device of this invention consists mainly of 11 vertical stackers numbered 1 through 11. In addition, an overflow stacker 12 and a reject stacker 13 are provided. Each stacker has a paddle 16 shown in the raised position as will be subsequently explained. Emergency stop switches 18 are provided at various locations around the machine. Feed belt sections 20 are schematically illustrated. The flow then proceeds from the bottom of the stackers 1 through 11, along the feed belt 20, and subsequently enters a singulator 21. Flow from the singulator then passes through the leveler 22 and through the wide area bar code reader 24. The top transport section 26 is also schematically illustrated. Mail passing through the WABCR section enters the top transport 26 and flows to the appropriate stacker and enters the same through the top.

Stackers 1 through 11 are sort stackers which are used in each operation. Stacker 12 is an overflow stacker which will be used in the case of an overflow condition of one or more of the sort stackers 1 through 11. The reject stacker 13 handles all mail which cannot be sorted.

Figure 2:
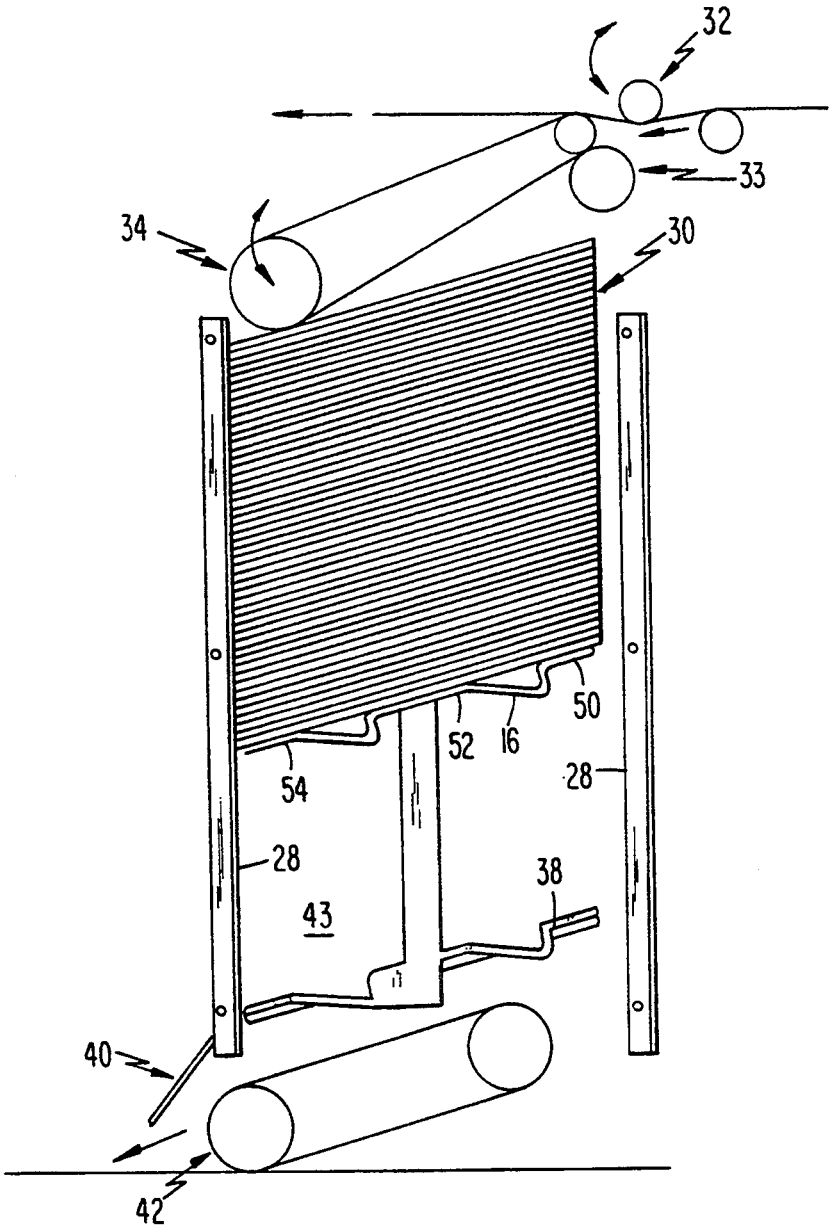
FIG. 2 is a schematic side view of a vertical stacker of this invention.

Prior to sequencing, the operator loads the mail face down into sort stackers 1 through 11 up to a predetermined height. The mail is loaded in the bottom portion of each stacker, below the paddle 16, so that the mail is resting on the shingler feeder 42. The shingler feeder 42 will be subsequently described with reference to FIG. 2. The stackers are loaded so that the mail will be contained in a descending stair step fashion from stacker 1 to stacker 11 or from left to right across as shown on FIG. 1. This in done to minimize the probability of any one stacker overflowing. Once the machine is loaded, it is ready to begin sequencing the mail. A microprocessor controls operation of the machine in a conventional fashion. The microprocessor will be programmed with the carrier's route sequence keyed to the bar code zip code read by the reader 24.

A sequencing pass begins when the first stacker 1 begins to feed mail. With attention to FIG. 2, each stacker consists in part of upright walls 28 which are used to contain and separate the stacks of mail, a vacuum shingler belt 42, and a stripper device 40. Upon feeding mail, a negative pressure is applied to orifices in the vacuum shingler belt 42 as the belt begins to move in a direction towards the feeder transport 20. The mail at the bottom of the stack is driven toward the feeder transport 20 in the direction of the vacuum shingler belt motion. The stripper device 40 retards the motion of all pieces except the bottom piece of the stack. During operation, this process pulls the mail stack out from beneath itself and presents it to the feeder transport 20 in a single continuous shingled stream of overlapping mail. This process begins with stacker 1 and proceeds to stacker 2 when stacker 1 empties, and so on until all the stackers have been emptied and all the mail fed.

Figure 3:
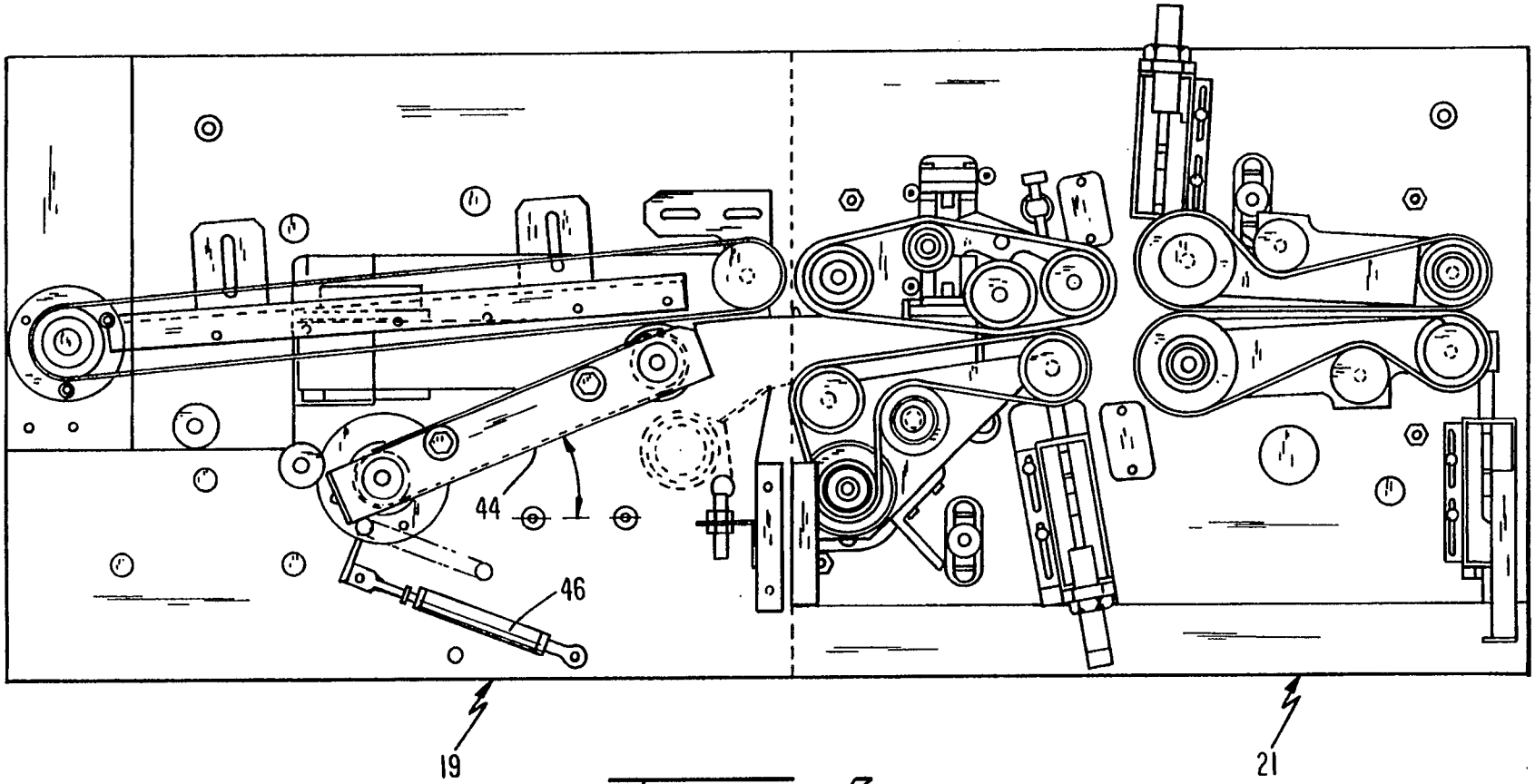
FIG. 3 is a schematic top view of both the buffer and singulator sections of the device of this invention.

The purpose of the feeder transport section 20 is to present the mail to the buffer 19 in advance of singulator 21. The speed of the vacuum shinglers 42 and the feeder transport are closely matched, providing a smooth transition for the mail to flow. The speed of the feeder transport is controlled by the amount of mail which is present in the buffer 19. With reference to FIG. 3, a pivoting arm 44 within the buffer is connected to the DC drive system (not shown) of the feeder transport 20. The arm 44 acts as a gauge which constantly monitors the amount of mail in the buffer 19. As the amount of mail in the buffer 19 decreases, the spring-loaded buffer arm 44 will move toward its rest position (shown) and will depress the plunger 46 of a potentiometer (not shown). The resultant change in resistance is sensed by the DC transport drive system, thus accelerating the feeder transport and filling the buffer. In a likewise fashion, as the amount of mail in the buffer 19 increases, the feeder transport 20 decelerates. In operation, the system quickly reaches a point of equilibrium where the amount of mail being taken out of the buffer 19 by the singulator is equal to the amount of mail entering the buffer 19 from the transports.

The shingled mail stream being presented to the buffer 19 of the singulator 21 represents the ordered mail exiting stackers 1 through 11. The first mail piece presented to the singulator 21 for singulation is at the bottom of the first stacker 1 and the last mail piece presented for singulation is the top piece of the last stacker 11. Sequence integrity is maintained at all times through the shingled feed system.

The purpose of the singulator 21 is to pick-off pieces from the output of the feed buffer and place them on the downstream transport, one piece at a time. The singulator 21 is a computer-controlled servo-system which places a predetermined gap (preferably 3.25 inches) between the trailing edge of one piece of mail and the leading edge of the next piece of mail. With regular letter mail, this produces a throughput rate of approximately 10 letters per second.

With reference to FIG. 1, sometimes letters exit the singulator 21 skewed with respect to the horizontal. Unfortunately, the WABCR 24 downstream cannot tolerate more than a 5 degree skew and still make a good read of the bar code on the envelope. The leveler 22, which is disposed between the singulator 21 and the WABCR 24, is used to eliminate mail skewing for proper WABCR reading. Leveling is accomplished by allowing the mail to fall between two wide vertical belts and to ride on a horizontal belt beneath (not shown). During the time the mail is in the leveler section 22, the mail will level itself under the influence of gravity.

After the mail leaves the leveler 22, it enters the reader section 24. Here the mail is transported at a fixed speed past the bar code reader. The bar code reader, preferably the USPS wide area bar code reader (WABCR), reads the post net bar codes anywhere within the bottom four inches of the envelope, including bar codes which are embedded within the address block on the envelope. The reader extracts the appropriate zip code information from the bar coded envelope and transmits this information back to the microprocessor (not shown). The microprocessor will then make the decision based upon the zip code information received as to which stacker the mail piece will be sent to and then signals the selected stackers gating mechanism 32 at the appropriate time. (See FIG. 2.)

After the mail leaves the reader 24, it is transported to the top section where it is further transported to the appropriate stacker and gated off. Again referring to FIG. 2, as mail approaches the selected stacker, it is sensed by a photocell (not shown) preceding the stacker. The computer then initiates the firing of the appropriate gate diverter solenoid (not shown). The CSBCS device of this invention utilizes a flex belt diverter. When the gate diverter solenoid is actuated, it pushes a pivoting roller 32 against the transport belt in the direction of the stacker. The transport belt, which is elastic, deflects when the roller is pushed against it—diverting the mail piece into the stacker.

As mail enters the stacker, the stack 30 grows downward toward the shingler belts 40 of the respective stacker. When all the mail has been sorted, the mail stacks are automatically lowered downward by the action of the paddle 16, the paddle is then retracted placing the stack onto the shingler belts of their respective stackers, the stacker paddles are returned to the top of the stackers, and the whole process of sorting the mail is repeated under a different scheme. After all three passes are finished, the paddles are lowered and the device is ready to be swept. After the machine has completed sequencing the mail, the stackers are swept by manually removing the mail from the stackers from right to left taking the mail and placing it into mail trays. Trays are filled from back to front. The last piece of mail on the carrier's route is the first piece of mail swept and is placed in the back end of the tray. The first piece of mail on the carrier's route is the last piece swept and is placed in the front end of the tray.

A more detailed description of the stacker is as follows. With further attention to FIG. 2, the typical stacker shown therein is a vertical stacker as noted above which is not only used for stacking but also for feeding mail during the same pass.

When a mail piece is diverted from the top transport 26 into a stacker, a flanged pulley 33 at the input to the stacker bends the mail in a transverse direction with respect to the mail flow, providing rigidity to the mail piece as it enters the top of the stack 30. As the mail piece enters the stack, it comes into contact with the stacker pulley 34 which rests on top of the stack. The stacker pulley contains two friction wheels which assist the mail piece across the top of the stack and over to the forward stacker wall 28, providing proper edging.

The stacker pulley 34 is spring-loaded and exerts a slight pressure on the top of the stack. As mail enters the stacker, the stacker pulley 34 rises slightly. A proximity sensor (not shown) detects this rise after if reaches a predetermined threshold and signals the microprocessor to lower the paddle. The paddle is attached to a motor (not shown) controlled x-y slide mechanism (not shown) which is capable of moving the paddle 16 through all of its required motions. When the paddle 16 is lowered, the stacker pulley 34 is also lowered along with it to the point that the sensor is deactivated. When the sensor is deactivated, the paddle stops. In this way, a relatively constant pressure is maintained by the stacker pulley 34 on the mail stack. This is critical for proper stacking.

As mail enters into the stacker, the mail stack grows downward toward the bottom of the stacker. When the pass is completed, the paddle 16 is lowered to the bottom of the stacker and is retracted through a slot 38 in the lower portion of the stacker. When the paddle is retracted, the mail stack on the top of the paddle 16 is deposited onto the shingler belt 42 at the bottom of the stacker. The paddle 16 is then raised to the top of the stacker from behind the base plate 43, re-extended through another slot 38 in the top of the base plate 43, and repositioned directly beneath the stacker pulley 34. At this point, the next pass is ready to begin by shingling the mail out of the bottom of the stacker.

The paddle 16 is designed so that it can be retracted through the slot 38 in the base plate 43 without disturbing the stack and at the same time facilitate sweeping. The paddle has a zig-zag design wherein three supporting places (50, 52 and 54) are provided which are contained in a common plane disposed at an angle to the horizontal and at an angle approximating that of the vacuum shingler belt 42. Between coplanar portions 50, 52 and 54 are substantially horizontal sections which are at angles which are not parallel to the angles containing the supporting sections 50, 52 and 54. The slot 38 then conforms to the profile of the paddle so that the paddle can be retracted through the slot and will not carry with it any mail resting thereon. The portions of the slot 38 disposed between the coplanar portions 50, 52 and 54 block the exit of any mail from the stack with the paddle. As also is evident, the paddle design assists the operator in sweeping by providing a place for fingers when lifting the stack off of the paddle which corresponds to the angular sections between the coplanar supporting sections 50, 52 and 54 in FIG. 2.

OVERFLOW

The device of this invention is intended to function in an overflow capacity while still maintaining the sequential order of the mail. The device of this invention utilizes the same stacker to feed mail as it uses to receive the sorted mail. The mail is fed from the bottom of the stacker and simultaneously received at the top thereof. The possibility exists then that the new stack which is growing downward from the top may eventually meet with the old stack, which has not yet fed out of the bottom. The probability of this condition occurring is higher for the higher numbered stackers since they are the last to be fed out. To prevent the top stack from running into the bottom stack, a sensor (not shown) has been mounted on the bottom of each stacker paddle 16 so that if the top stack reaches the bottom stack, a signal is sent to the computer. Any further mail destined for this stacker is then diverted to the overflow stacker 12. This condition is referred to as a temporary overflow since once the mail in the bottom portion of the stacker has been fed out, the stacker is once again free to accept more mail. Under normal circumstances, if there is mail in the overflow stacker at the end of a pass, the paddle in the overflow stacker will drop and deposit its mail onto the overflow shingler belt. The mail will then be recycled back through the system before beginning the next pass. In temporary overflow, it is necessary that once a stacker is in the overflow condition, its mail must be diverted to the overflow stacker until the overflow stacker is recycled at the end of a pass. This is true whether the bottom portion of the overflow stacker is fed out before the end of the pass or not. This is necessary in order to maintain the proper sequence of the mail, since diverting mail to the stacker which overflowed prior to the recycling the mail which has previously overflowed from that stacker would cause a break in the sequential order of mail within that stacker.

The one overflow stacker 12 can serve temporary overflow from stackers 1 through 11 simultaneously. Even though the mail in the overflow stacker is an intermingling of the overflow from various stackers, all of the mail within the overflow stacker is still in the proper sequence relative to the stackers from which it was diverted. Therefore, when the overflow stacker is recycled, mail is read again by the bar code reader and these mail pieces routed back to the stackers in which they belong, while maintaining the sequential order of the mail.

If the overflow stacker becomes full during normal processing, all processing will stop and the overflow stacker will be immediately recycled, freeing up more space in the overflow stacker 12. Otherwise, the overflow stacker will normally be recycled at the end of a pass.

With attention to FIGS. 4A–D, FIG. 4A shows the normal routine of the device of this invention wherein stackers 1 through 11 are filling and stacker 1 is emptying out the bottom for sortation.

Figures 4A, 4B, 4C, 4D:
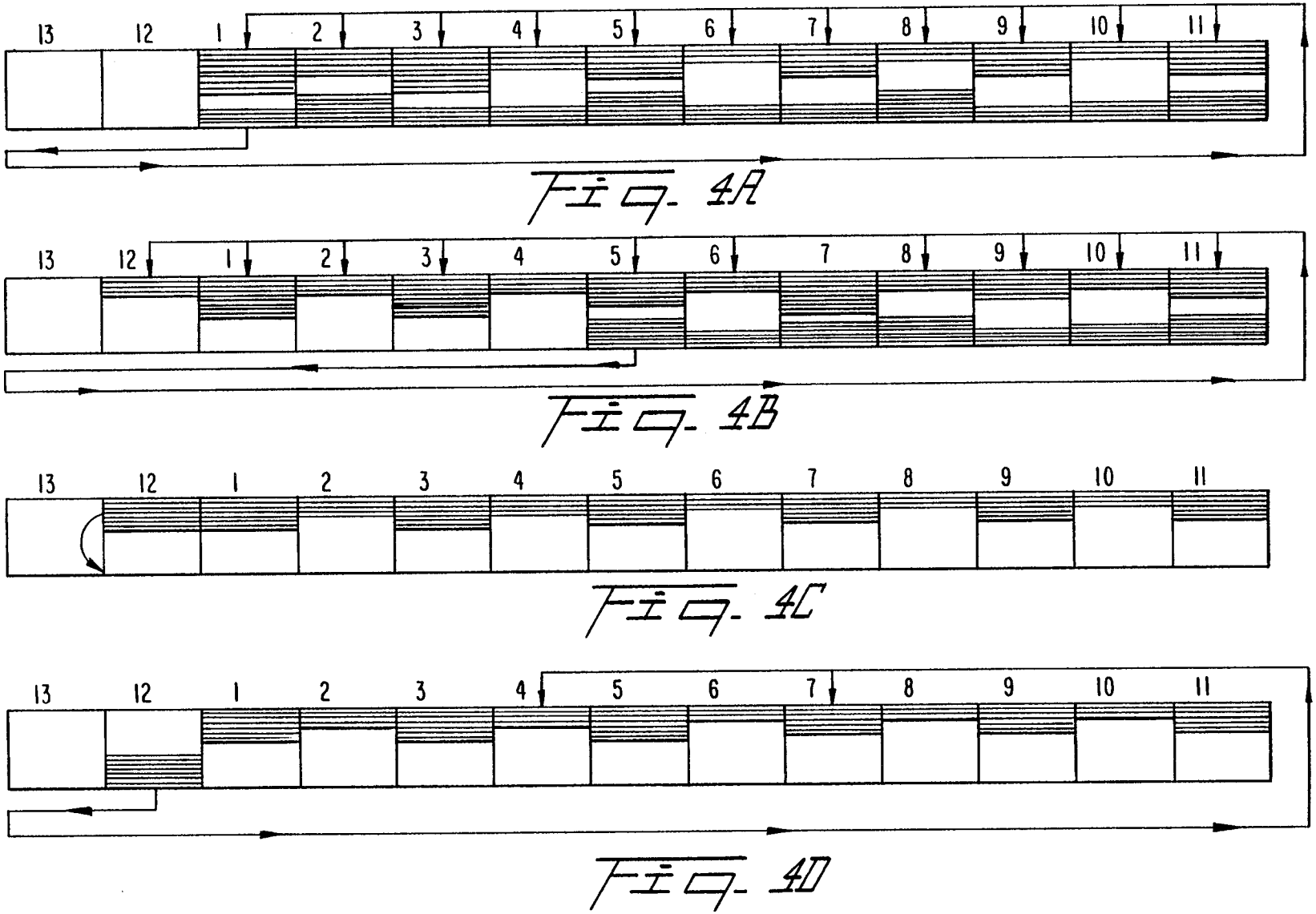
FIG. 4A illustrates normal sequential mail shingling-/feeding/stacking.
FIG. 4B is similar to FIG. 4A except that stackers 4 and 7 have both temporarily overflowed.
FIG. 4C is a schematic view similar to FIG. 4B illustrating the end of a pass wherein the overflow stack is recycled.
FIG. 4D, similar to FIG. 4C, illustrates the recycling of the overflow back into stackers 4 and 7.

FIG. 4B illustrates the situation wherein stackers 4 and 7 have both temporarily overflowed. The overflow is then routed to the overflow stacker designated reference number 12. At the end of the pass (FIG. 4C), the stack in the overflow stacker is dropped down onto its associated belt and (FIG. 4D) the overflow from stackers 4 and 7 is routed back to these stackers from the bottom of the overflow stacker 12.

The other overflow condition which can occur is true overflow. A true overflow occurs when the mail designed for a particular stacker exceeds the stacker's total capacity. True overflow mail, like temporary overflow mail, is diverted to the overflow stacker 12 and is intermingled with the rest of the mail in the overflow stacker. During the temporary overflow recycle time, however, the temporary overflow is gated out into the stackers where it belongs and the true overflow mail is returned to the overflow stacker.

This overflow mail is lowered and deposited onto the shingler belts at the same time as the rest of the mail at the end of the pass. During the next pass, the true overflow mail is fed back into the mail stream immediately following the stacker from which it overflowed. Only one true overflow is allowed per pass.

Stacker overflow is an undesirable situation because it requires time to recycle the overflow stacker and thus increases the overall time to sequence the mail. It is desirable then to reduce to a minimum the probability that an overflow will occur. If the mail is distributed evenly across all of the stackers on high volume runs, the higher numbered stackers would tend to temporarily overflow as previously described. Computer modeling has been performed to determine the percentage of the total mail volume which should be dedicated to each stacker in order to achieve a minimum probability of temporary overflow occurring. The computer modeling showed that the minimum probability of overflow occurs when the mail is distributed in a downward stair step fashion from left to right across the machine and across FIG. 1. In this way, the stacker which normally would be the most likely to overflow, the right-most stacker, would have the least amount of mail dedicated to it. For the 11 sort stackers machine of this invention, the percentage of mail dedicated to each stackers from 1 to 11 respectively is as follows: 13.20, 11.66, 10.57, 9.75, 9.10, 8.56, 8.11, 7.73, 7.39, 7.10 and 6.83.

The process of distributing stops in order to achieve the minimum probability of overflow is known as optimization. Optimization is possible as a consequence of the machine having excess stop capacity, as noted above. Since the device of this invention uses eleven sort stackers and runs the mail through three passes, there are a total of $11 \times 11 \times 11 = 1331$ possible stops. The maximum number of sort stops is 1000, therefore, there are a minimum of 331 spare (blank) stops which are not assigned to any zip code. By assigning zip codes to stops in a specific manner and placing blank stops at key areas between the assigned stops, it is possible to distribute the mail in an optimum fashion to minimize overflow probability.

Figure 5:
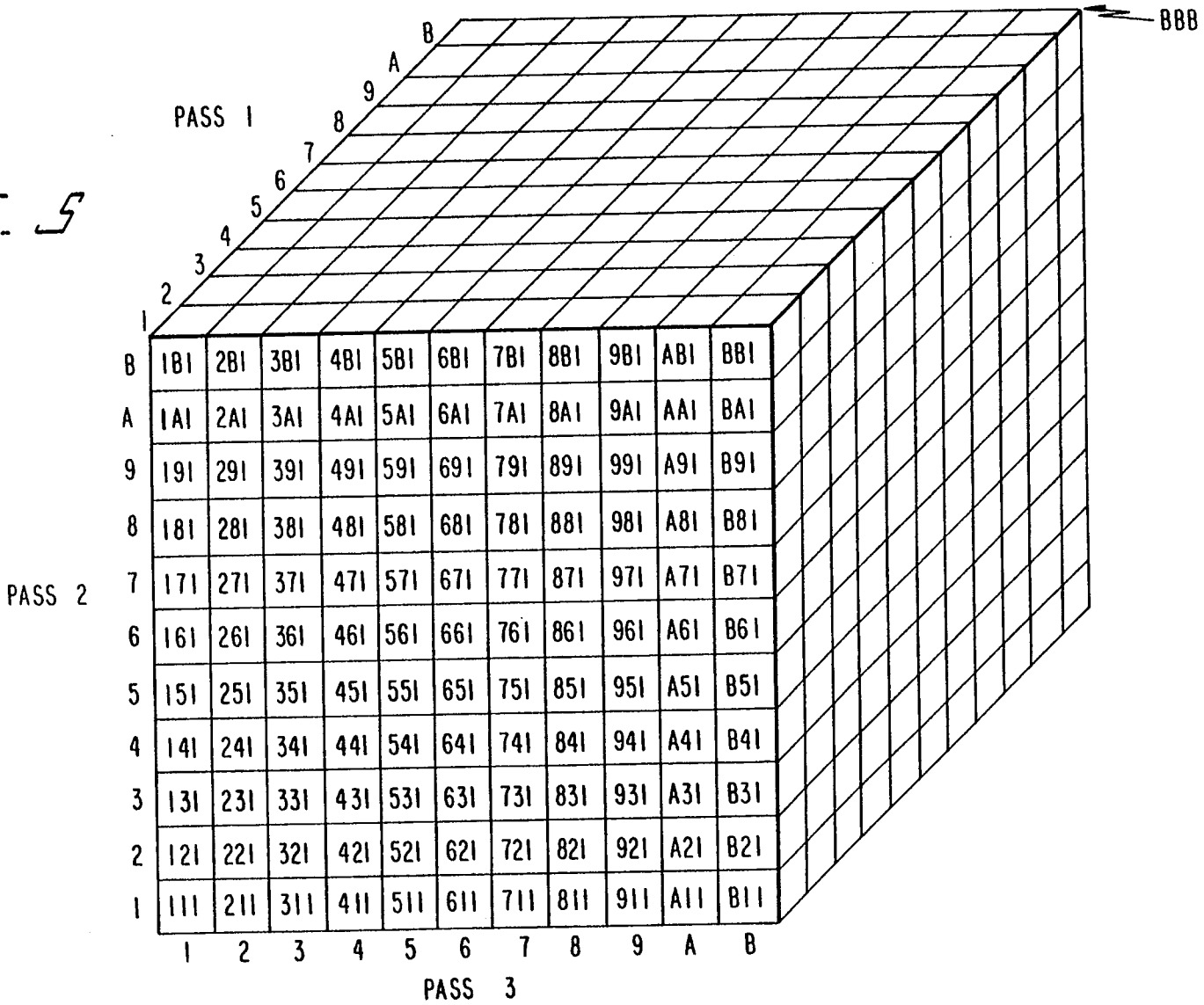
FIG. 5 is a schematic array of a stop table with zip codes assigned as a three dimensional array.

With reference to FIG. 5, the stop table to which the zip codes are assigned can be envisioned as a 3-dimensional array containing 1331 elements or stops. The tiers of the array are comprised of the stops associated with the 11 sort stackers during the first pass. The columns of the array are comprised of the stops associated with the 11 sort stackers during the third pass. In a likewise manner, the stop number associated with each elemental block of the array is associated with its assigned stacker during the first, second, and third passes by its first, second, and third Least Significant Digits (LSDs), respectively as shown. The very first stop is therefore 111 and is located at the front bottom left-hand corner of the array. The second stop is 112 and is located directly behind the first stop and thus cannot be seen in the figure. The twelfth stop is 121 and is located directly above the first stop as indicated in the figure. The very last stop is BBB and is located at the rear upper right-hand corner of the array.

Figure 6:
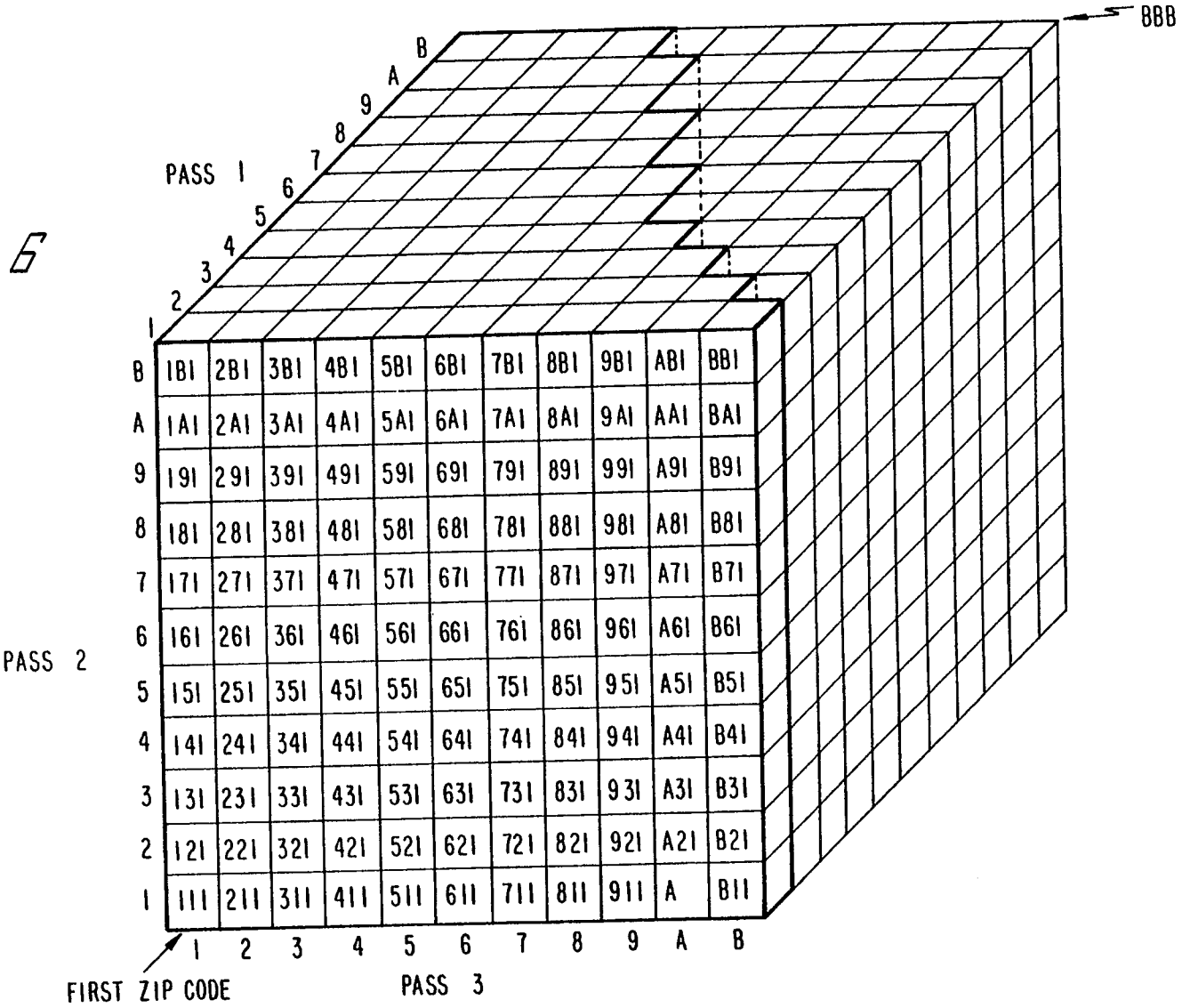
FIG. 6 is an array similar to FIG. 5 with the expected stair step distribution for the first pass shown as shaded spaces.

Prior to executing the first pass the machine of this invention loads the sequentially ordered ZIP coded route of the mail carrier into the microprocessor system memory. Along with the ZIP code information, the expected percentage of mail for each particular zip code is also loaded into memory. This information was previously loaded onto the hard disk drive of the microprocessor as will be subsequently described. With reference to FIG. 6, the first ZIP code is assigned to the first stop 111. The second ZIP code is assigned to stop 112 and so on in a sequential fashion. After each ZIP code is assigned to the array, a sum is calculated of the associated percentages from each ZIP code within each of the tiers of the array. These sums represent the expected percentage of mail which is being destined for each of the stackers during the first pass. After the sum for a particular tier exceeds the optimal percentage as described previously no further zip codes are assigned to that tier. For example, tier B is closed off after the sum of its assigned stops exceeds 6.83% as previously described. Tier A is closed off after the sum of its assigned stops exceeds 7.10%. The microprocessor continues to assign ZIP codes to stops in a sequential fashion ignoring the closed off tiers until all of the ZIPs have been assigned. The shaded stops represent the assigned stops and the unshaded stops represent the blank stops. FIG. 6 represents the expected stair stepped distribution for the first pass as previously described.

During the first pass, the ZIP codes read by the bar code reader are related back to the associated stop number within the array and sorted to the stacker corresponding to the LSD of the stop number. After the first pass is completed the microprocessor can determine exactly what percentage of the total mail volume is associated with each of the ZIP codes in the carrier's route. At this point, the microprocessor can reassign ZIP codes to stops within the array to further optimize the mail distribution in the stackers for the second and third passes. This is referred to as Dynamic Redistribution.

The assigned ZIP codes within the array may be reassigned to different stops provided that two conditions are met. The first condition is that ZIP codes within a tier may not be moved outside of the tier. This is because the mail has already been sorted to the tier level during the first pass and is therefore set. The stops within the tier may be moved around with respect to row and column however based on the second condition. The second condition is that the sequence of the ZIP codes remain true with respect to the sequence of the stops. For example, the 42nd ZIP code of the carrier's route must be preceded in stop number by the 41st ZIP code of the carrier's route. If ZIP code 41 is assigned to stop number 551, then ZIP code 42 must be assigned to a stop number greater than 551. Stop number 761 would suffice to meet this condition, however, stop number 491 would not since it is lower in stop number sequence than 551.

In accordance with these two conditions, the microprocessor then reassigns the ZIP code table to the stop table based on the actual percentages determined during the first pass. The same method is applied to locate the ZIPs within the array for the second and third passes as was used in locating the ZIPs within the array for the first pass. The ZIP codes are individually placed into the array and the sum of the associated percentages for both the rows and columns is calculated. After the sum for a particular row or column exceeds the optimal percentage, as calculated for that row or column, no further ZIP codes may be assigned to that row or column. The microprocessor continues to assign ZIP codes to stops in a sequential fashion ignoring the closed off rows and column until all of the ZIPs have been assigned.

Figure 7:
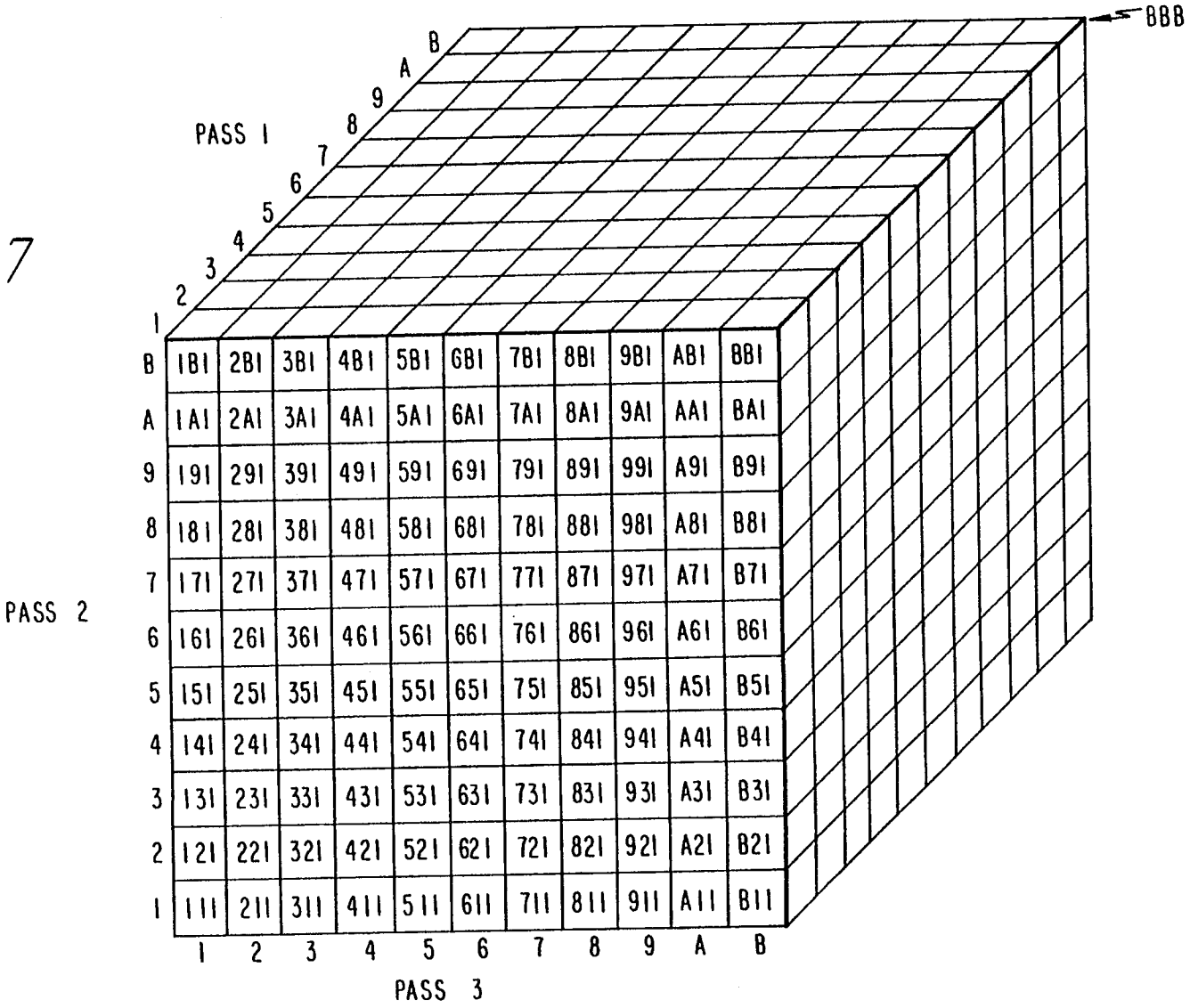
FIG. 7 is an array similar to FIG. 6 showing dynamic redistribution of zip codes to stops with the stop array shown as shaded spaces.

FIG. 7 depicts the conclusion of this process. The stop array will have the assigned stops distributed in a pseudo-random fashion throughout. The assigned stops will be concentrated to the front, lower, left-hand corner where the distribution probability is highest for the lower numbered stacker. The assigned stops will be scarce in the rear, upper, right-hand corner where the distribution probability is lower for the higher numbered stackers. The sums of the percentages associated with the ZIPs assigned to the various stops in the rows, columns, and tiers of the array should all approximate the optimum distribution percentages described earlier. During the second and third passes, the ZIP codes read by the bar code reader are related back to the associated stop number within the array and sorted to the stacker corresponding to the second and third LSD of the stop number respectively. This in turn will distribute the mail in sequence in the desired stair-stepped fashion for minimal probability of overflow.

After the run is finished, the microprocessor averages the data related to mail distribution percentages from the run with the data from previous runs and stores this information onto the hard disk. As described previously, the data is used by the microprocessor for optimization of the mail distribution during the first pass of the next run for this carrier. In effect, the microprocessor learns the carrier's route and adapts to any changes which may occur.

The device of this invention uses a three-pass system to provide 11 different sort stackers and an efficient and effective machine for carrier sequencing bar code sorting. The stackers are capable of receiving mail in the top at the same time as they are feeding mail from the bottom and a unique paddle design facilitates the receiving of mail from the top of the stacker while simultaneously feeding mail from the bottom.

The stackers also contain a novel design at the input which maintains a constant pressure and allows stacking in the vertical direction. Furthermore, the device of this invention incorporates optimization and dynamic reallocation of stops within its sorting scheme to minimize the probability of overflow conditions and enhance throughput.

While the overall computer, singulator, leveler, and bar code reader may be of conventional, known design, the device of this invention has been found to be capable of sequencing the carrier's entire route rapidly and efficiently and completely automatically from the feeding of the mail to the sweeping of the sequenced mail.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

We claim:

1. A document sorting machine for sorting documents to at least 1000 different stops and arranging said documents in a predetermined sequence comprising:

11 vertical stacker elements, each element having a top and a bottom and adapted to receive documents through the top, form a stack therein and dispense documents from the bottom either sequentially or simultaneously; feed transport means communicating with the bottom of each stacker for receiving a flow of documents therefrom; singulator and leveler means intercepting said flow for spacing each individual document from adjacent documents to form a singular flow and for orienting each of said documents in a predetermined configuration;

reader means for reading indicia on each document and relating the same to the predetermined sequence; and top conveyor means for conveying each document from the reader to the corresponding stacker for admission thereto; and means for cycling said documents a total of three times through said machine until said documents are arranged in said sequence each of said stacker elements mounting a paddle therein which is adapted to support a stack thereon as the stacker fills and to deposit said stack at the bottom of said stacker said paddle having an upper document supporting surface with three coplanar sections disposed at an acute angle to the horizontal with two intermediate substantially horizontal sections to form a zig-zag profile said machine further comprising means for withdrawing said paddle horizontally from said filled vertical stacker and for translating said paddle vertically upwardly and then horizontally into said stacker to receive a new stack of documents.

2. The machine of claim 1 wherein each stacker further comprises a stacker gate pulley disposed at the top thereof, adapted to rest on a stack retained therein.

3. The machine of claim 1 wherein each stacker further has a shingler at the bottom thereof for dispensing a shingled flow of documents from the bottom thereof into the feed transport means.

4. The machine of claim 1 further comprising overflow means communicating with said top conveyor means for receiving documents in a sequential stack which would normally cause a stacker to overflow for a predetermined period of time and for returning said documents sequentially to said feed transport means.

5. The machine of claim 4 wherein said overflow means includes an additional stacker.

6. The machine of claim 5 wherein said overflow means includes means for diverting documents which would cause a stacker to overflow to said overflow stacker and for subsequently recycling said documents.

7. The machine of claim 1 further comprising buffer means upstream of said singulator means coupled to said feed transport means for regulating the flow of documents therefrom into said singulator.

8. The machine of claim 2 further comprising buffer means upstream of said singulator means coupled to said feed transport means for regulating the shingled flow of mail to provide a uniform flow thereof to said singulator.

9. The machine of claim 2 wherein the stacker pulley normally exerts downward pressure on said stack as it fills said stacker, said paddle being coupled to said pulley so that it displaces downwardly responsive to filling pressure on said pulley.

10. A document sorting machine for sorting documents to up to 1000 different stops and arranging said documents in a predetermined sequence of stops comprising:

a plurality of vertical stacker elements, each element having a top and a bottom and adapted to receive documents through the top, form a stack therein and dispense documents from the bottom, sequentially; each stacker having a shingler at the bottom thereof for dispensing a shingled flow of documents from the bottom thereof, feed transport means communicating with the bottom of each stacker for receiving a flow of documents therefrom; singulator and leveler means intercepting said flow for spacing each individual document from adjacent documents to form a singular flow and for orienting each of said documents in a predetermined configuration; buffer means upstream of said singulator means coupled to said feed transport means for regulating the shingled flow of mail to provide a uniform flow thereof to said singulator said buffer means including a pivotal arm adapted to ride on said shingled flow and pivot to displace when said flow changes from a predetermined volume flow rate.

11. A method for sorting mail to a carrier route sequence of at least 1000 steps by indicia printed thereon comprising the steps of:

providing 11 vertical stackers having a top feed entrance and a bottom outlet;

providing shingler means at the bottom of each stacker for removing a shingled flow of individual documents therefrom and paddle means within each stacker for supporting a documents entering through the top thereof and subsequently depositing the stack on the shingler means at the bottom thereof;

providing a flow of mail documents, orienting each individual document and reading individually the indicia thereon and subsequently conveying each document into a predetermined stacker through the top thereof;

removing the mail documents individually from the bottom of each stacker in a predetermined sequence and repeating the steps of orienting, reading, and conveying each document to a predetermined stacker in two subsequent passes until the documents have been sorted to the carrier route sequence, and removing the stacks of documents from the stackers in a predetermined order providing overflow means coupled to said paddle means for depressing said paddle means as documents enter said stacker until said paddle means contacts a stack of documents retained on the shingler means and for subsequently diverting the inflow of documents from said stacker to an overflow stacker.

12. The method of claim 11 wherein the indicia is zip code encoded bar codes and the step of reading the indicia is achieved with a wide area bar code reader.

13. The method of claim 12 wherein the zip code has 11 digits.

14. The method of claim 11 further comprising initially stacking the documents to be sorted in sequence in said stackers to predetermined heights to minimize the likelihood that one of said stackers might be filled to overflowing as said documents are sorted.

15. The method of claim 14 wherein 11 stackers are provided and said documents are sorted in three passes.

16. The method of claim 15 wherein the excess sorting stops provided three passes are used to provide a different level of mail to be sorted in each stacker by allocating said excess stops to predetermined stackers.

17. The method of claim 11 further comprising orienting said shingled flow by providing a singulator and a leveler and passing said flow through the shingled flow through the singulator to establish a flow of spaced apart documents and then through the leveler to establish a specific angle relative to the horizontal for each singulated document.

18. The method of claim 17 further comprising buffering the shingled flow to the singulator so that the volume flow rate thereto will be substantially constant.

19. The method of claim 18 wherein the indicia is a bar coded zip code and the step of reading the indicia is carried out by a wide area bar code reader.

20. The method of claim 11 further comprising providing a stacker gate pulley disposed at the top of each stacker, operating said pulley to receive each document entering through the top of the stacker onto the stack therein, maintaining the stacked documents in said stacker with a common edge and maintaining a predetermined substantially constant downward pressure on the stack with said pulley.

21. A method for sorting mail to a carrier route sequence of up to 1000 stops by indicia printed thereon comprising the steps of:

providing at least 10 vertical stackers having a top feed entrance and a bottom outlet providing shingler means at the bottom of each stacker for removing a shingled flow of individual documents therefrom providing paddle means within each stacker for supporting a stack of documents entering through the top thereof and for subsequently depositing the stack on the shingler means at the bottom thereof;

providing a flow of main documents sequentially from each stacker, orienting each individual document and reading individually the indicia thereon and subsequently conveying each document into a predetermined stacker through the top thereof in a first pass;

removing the mail documents in a shingled stream, from the bottom of each stacker in a predetermined sequence and repeating the steps of orienting, reading, and conveying each document to a predetermined stacker in subsequent passes until the documents have been sorted to the carrier route sequence, and removing the stacks of documents from the stackers in a predetermined order providing overflow means coupled to said paddle means for depressing said paddle means as documents enter said stacker until said paddle means contacts a stack of documents retained on the shingler means and for subsequently diverting the inflow of documents from said stacker to an overflow stacker.

22. The method of claim 21 wherein the step of depositing the stack from the paddle means onto the shingler means includes retracting the paddle means from the stacker without disturbing individual documents in the stack.

23. The method of claim 21 wherein an additional stacker is provided and the step of diverting includes conveying the overflow documents to said additional stacker.

24. A method for sorting mail to a carrier route sequence of up to 1000 steps by indicia printed thereon comprising the steps of:

providing 11 vertical stackers having a top feed entrance and a bottom outlet;

providing a flow of mail documents sequentially from each stacker, orienting each individual document and reading individually the indicia thereon and subsequently conveying each document into a predetermined stacker through the top thereof in a first pass;

removing the mail documents in a shingled stream, from the bottom of each stacker in a predetermined sequence and twice repeating the steps of orienting, reading, and conveying each document to a predetermined stacker in two subsequent passes for a total of three passes until the documents have been sorted to the carrier route sequence initially stacking the documents to be sorted in sequence in said stackers to predetermined heights to minimize the likelihood that one of said stackers might be filled to overflowing as said documents are sorted the excess sorting stops provided by three passes being used to provide a different level of mail to be sorted in each stacker by allocating said excess stops to predetermined stackers the first stacker to empty during a pass initially containing documents stacked to the greatest height and the stacker to empty containing documents stacked to the lowest height.

* * * * *